US007336196B2

(12) United States Patent
Howell

(10) Patent No.: US 7,336,196 B2
(45) Date of Patent: Feb. 26, 2008

(54) AUDIO VISUAL HOMING MARKER

(76) Inventor: Christopher Howell, 205 Mt. Pellier, Frederiksted, St. Croix, VI (US) 00640

( * ) Notice: Subject to any disclaimer, the term of this patent is extended or adjusted under 35 U.S.C. 154(b) by 211 days.

(21) Appl. No.: 11/273,011

(22) Filed: Nov. 14, 2005

(65) Prior Publication Data

US 2007/0109144 A1 May 17, 2007

(51) Int. Cl.
*G08B 5/22* (2006.01)
*G09F 9/33* (2006.01)

(52) U.S. Cl. ..... 340/815.45; 340/471; 340/691.1; 362/202

(58) Field of Classification Search ..... 340/815.45, 340/573.1, 815.4, 815.69, 471, 983, 691.1, 340/692, 693.5; 362/555, 559, 84–86, 113, 362/202, 203, 369
See application file for complete search history.

(56) References Cited

U.S. PATENT DOCUMENTS 5,066,256 A * 11/1991 Ward, Sr. ..... 441/7
5,390,581 A * 2/1995 Hiltz et al. ..... 89/1.812
6,864,799 B2 * 3/2005 Popps et al. ..... 340/693.58
7,148,811 B1 * 12/2006 Bustamante et al. ..... 340/850
2007/0090959 A1 * 4/2007 Rainczuk et al. ..... 340/574

* cited by examiner

*Primary Examiner*—Toan N. Pham
(74) *Attorney, Agent, or Firm*—Timothy M. Barlow

(57) ABSTRACT

An audio visual homing marker includes a shock-resistant housing with a power supply, audio speaker and LED array inside the housing. A power switch is attached to the housing and the power supply. The housing includes a plurality of bulkheads that create a plurality of chambers. The power supply, the audio speaker and the LED array are each contained within separate chambers. The power switch is biased to the on position. The housing is a generally cylindrical polycarbonate structure and may be a transparent material. The LED array may include a plurality of LEDs attached around the perimeter of the housing. The audio speaker can be a siren or other loud speaker. The LED array may emit a visible or non-visible light. A variety of holders and dispensers make it easy to deploy the markers from a car or aircraft.

13 Claims, 2 Drawing Sheets

AUDIO VISUAL HOMING MARKER

BACKGROUND OF THE INVENTION

1. Field of the Invention

The present invention relates to beacons and markers, and more specifically to a portable, weather-resistant, audio and visual marker for identifying a geographical place of interest.

2. Description of the Related Art

Various types of markers and beacons have been used for decades. These devices permit a person to mark a place so that he may return later, or aid to identify a place so that a traveler can identify his position. These include permanent markers on the ground that are used by aviators, such as navigational aids, and buoys used on the sea by mariners.

More recently, a need has become apparent for a marker that can be temporarily deployed. Such devices would be used by military and police who have the need to quickly mark a location for later return. The conditions faced by such a marker are severe. They may be dropped from an aircraft to mark the location of illegal crops or thrown from a moving police car to mark possible evidence. The markers are subject to extreme abuse and shock. Thus, these markers must be rugged. Further, due to the nature of their use, the markers may be lost quite easily. Thus, they need to be inexpensive as well.

Currently, there are no markers available that are able to be thrown or launched from an aircraft or automobile that are rugged, reliable, simple to use, and inexpensive. Existing technology requires the use of parachutes or other speed-reducing components, handles, and ground-engaging portions, such as a spike. These features greatly increase the size, weight, complexity and cost of a beacon. In addition, any ground-engaging feature is quite hazardous to those on the ground.

Therefore, there has been and continues to be a need for an audio and visual marking device that easy to manufacture and maintain, reliable in all conditions, and rugged enough to withstand tremendous impact forces.

SUMMARY OF THE DISCLOSURE

The device is an audio visual homing beacon for law enforcement personnel, military, and others. The device's main housing is a generally cylindrical tube that contains all of the other components. The housing is polycarbonate or a similar material that is very rugged to withstand a tremendous amount of abuse. Several bulkheads are located within the housing to compartmentalize the housing and provide additional strength. The housing holds a rechargeable battery, a light source, a very loud speaker, a power switch and the necessary wiring to properly connect the components.

The device is used to mark locations of interest to police, military and others. It may be deployed from an automobile or an aircraft, and does not require a parachute when air-dropped. A parachute is counterproductive because it causes the beacon to drift instead of dropping straight to the ground. An LED array provides a visual light source that combines a bright light with low power consumption and ruggedness. Alternatively, the LEDs emit a non-visible light, such as infrared or ultraviolet. Personnel would need to use night vision goggles or other spectrum-appropriate equipment to see the beacon.

The power switch is spring-loaded and biased to the on position. The user does not need to turn the device on. The device is held within a rack or holder so that the power switch is held in the off position. Thus the device defaults to operation when removed from its rack or holder. The user does not need to look for a switch; he just throws it or launches it.

When used on an aircraft, a rack or launcher may hold one or more beacons, ready for deployment. The beacons may be launched one at a time, manually or remotely. As above, the beacons automatically activate as they are released.

As the beacon is very rugged, no parachute is required or desired. The beacon can withstand a fall and operate properly, with lights and siren, so that those on the ground can find the beacon and any associated items of interest.

It is an object of the invention to provide improved elements and arrangements thereof for the purposes described which is inexpensive, dependable and fully effective in accomplishing its intended purposes.

It is an object of the present invention to accomplish the foregoing objectives in a simple and cost effective manner.

These and other objects of the present invention will become readily apparent upon further review of the following specification and drawings.

DETAILED DESCRIPTION OF THE PREFERRED EMBODIMENT

The following detailed description is of the best presently contemplated modes of carrying out the invention. This description is not to be taken in a limiting sense, but is made merely for the purpose of illustrating general principles of embodiments of the invention.

Figure 1:
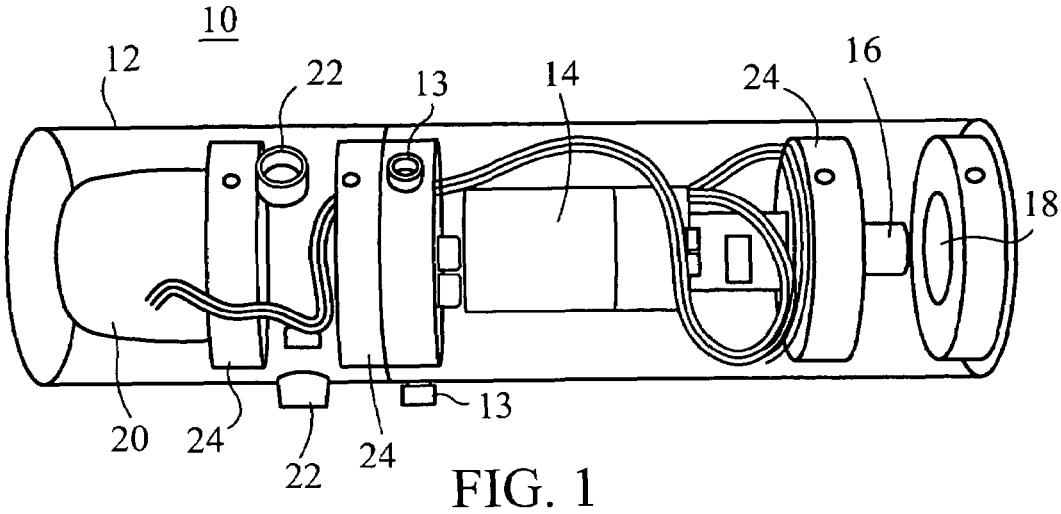
FIG. 1 is a side view of an audio visual homing marker, in accordance with the present invention.

FIG. 1 shows a side view of an audio visual homing marker 10 that includes a shock-resistant housing 12. The housing 12 may be of a polycarbonate material or another material that can withstand extreme impact forces. A power supply 14 is secured inside the housing 12. A power switch 16 is attached inside the housing 12 near an end and is accessible through an aperture 18 in the housing 12. The power supply 14 is attached to an audio speaker 20 and an LED illumination array 22 via the power switch 16. The audio speaker 20 may be a buzzer, a siren or other loud audio device that is rugged and has low power requirements. The audio speaker 20 is located near an end of the housing, opposite from the power switch 16. The LED array 22 is a plurality of LEDs that are mounted around the exterior of the housing 12. Alternatively, the LED array 22 is a plurality of LEDs distributed throughout the interior of the housing 12. The LED array 22 emits a steady light or can flash on and off. In another embodiment, the LED array 22 uses LEDs that emit a light that cannot be seen with the naked eye. In these cases, an infrared, ultraviolet or night-vision device is used to detect and locate the marker 10. This provides a high degree of security and stealthiness for law enforcement or military operations.

The housing 12 includes a plurality of bulkheads 24 that create a plurality of chambers within the housing 12. The housing 12 is easily opened with screws 13 or other fasteners to permit access to the internal components. The power supply 14, the audio speaker 20 and the LED array 22 may be secured within separate chambers. Any air space within the chambers can be filled with a foam insulation to absorb shock and provide impact resistance for the marker 10. In one embodiment, the power switch 16 is biased to the on position. In this manner, the user does not need to remember to turn the marker 10 on before it is deployed.

Figure 2:
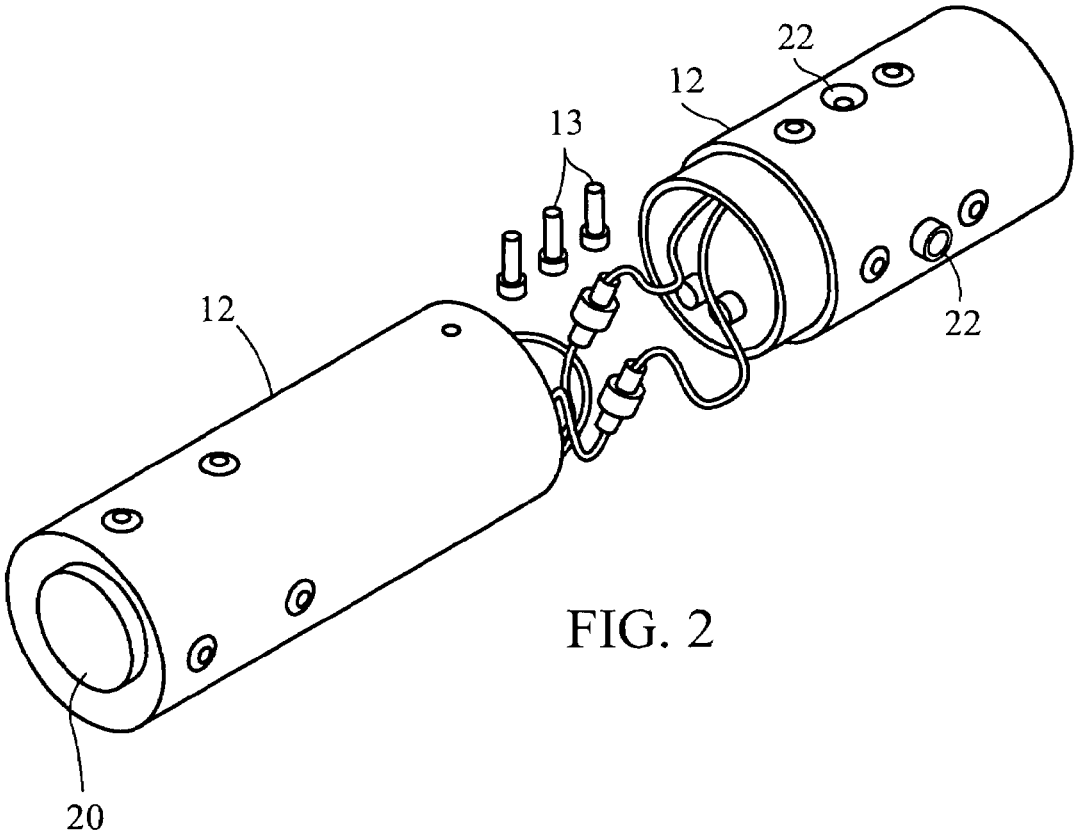
FIG. 2 is a perspective view of the audio visual homing marker, partially disassembled, in accordance with the present invention.

FIG. 2 shows a perspective view of the audio visual homing marker 10 that is partially disassembled. The housing 12 may be made from two or more sections that are easily attached and detached via a number of fasteners 13. This makes battery replacement easy and provides access for maintenance to the LED array 22 and the audio speaker 20 as well. FIG. 2 shows an opaque housing 12 that has an external LED array 22. LEDs 22 may be attached in visible positions around the housing 12.

Figure 3:
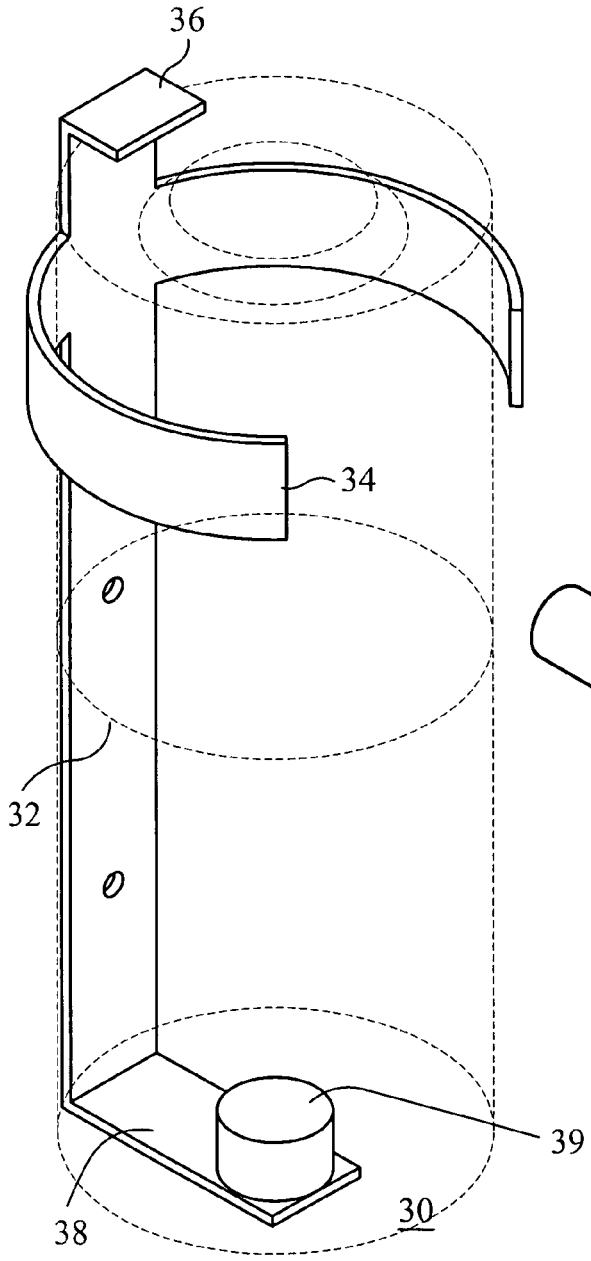
FIG. 3 is a perspective view of the audio visual homing marker in a dashboard mount, in accordance with the present invention.

FIG. 3 is a perspective view of the audio visual homing marker 10 in a dashboard mount dispenser 30. The dispenser 30 is releasably attached to the marker 10 and can be mounted in any convenient location for quick deployment of the marker 10. The dispenser 30 includes a base 32, which is about the same length as the marker 10. A flexible semicircular band 34 is perpendicular to the base 32. The band 34 partially surrounds the marker 10 and is biased to hold the marker 10 against the base 32. An upper tab 36 is attached to the upper end of the base 32, and a lower tab 38 is attached to the lower end of the base 32. A power switch block 39 is attached to the lower tab 38 and faces the upper tab 36. The block 39 depresses and maintains contact with the power switch 16 to bias the power switch 16 to the off position. The audio speaker 20 is shown at the top end of the dispenser 30, near the upper tab 36. The marker 10 is securely retained within the dispenser 30, between the upper tab 36 and the lower tab 38, and within the band 34. The marker 10 is easily released from the dispenser 30 simply by pulling the marker 30 straight away from the upper tab end of the base 32. As the block 39 is released from the power switch 16, the marker 10 automatically illuminates and starts to sound. The user then quickly deploys the marker 10. The marker 10 will continue to operate for many hours, until retrieved and turned off.

Figure 4:
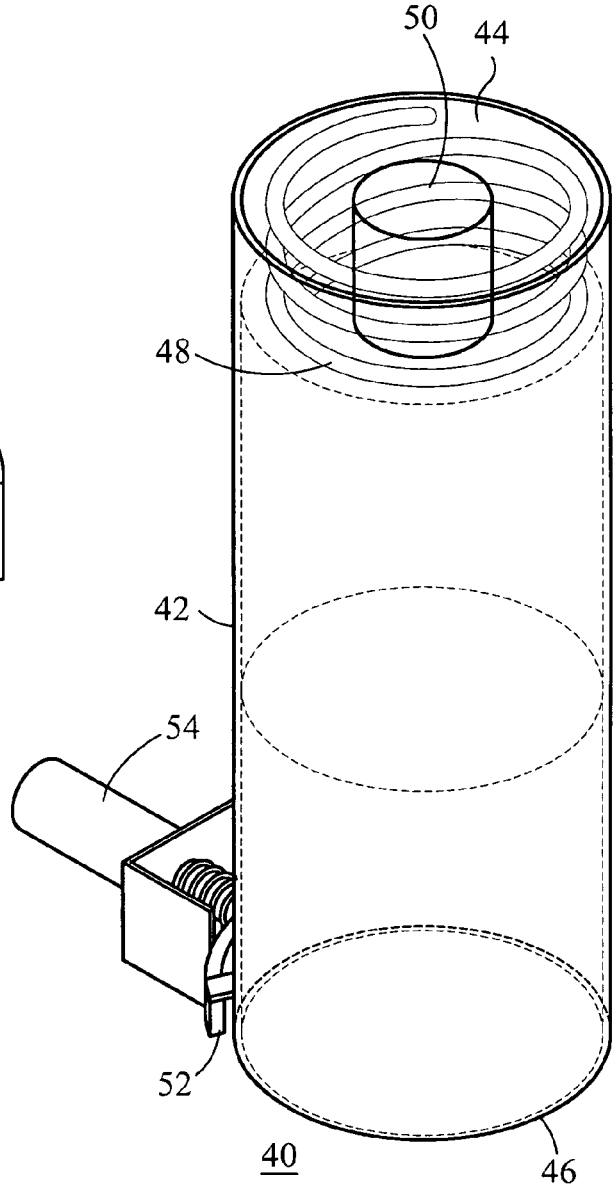
FIG. 4 is a perspective view of the audio visual homing marker in an ejector dispenser, in accordance with the present invention.

FIG. 4 is a perspective view of the audio visual homing marker 10 in an ejector dispenser 40. The ejector 40 releasably retains the marker 10 via spring power. The ejector 40 includes a cylindrical body 42 with a closed end 44 and an open end 46. A spring 48 is attached inside the closed end 44 and provides a biasing force upon the marker 10 toward the open end 46. A power switch block 50 is attached inside the closed end 44 of the cylinder 42. The block 50 maintains contact with the power switch 16 and biases the power switch 16 to the off position when the marker is within the ejector 40. A catch mechanism 52 is attached to the body 42 adjacent to the open end 46. The catch 52 acts to hold the internal marker 10 within the body 42 and against the block 50 and the spring 48. The catch 52 is shown attached to a solenoid 54. A remotely-controlled power source is connected to the solenoid 54. The solenoid 54 is biased to hold the catch 52 in contact with the marker 10.

As power is applied to the solenoid 54, the catch 52 is retracted from the marker 10. The spring 48 then forces the marker 10 from the cylinder 42. As the marker is released from the block 50, the power switch 16 automatically assumes the on position and the marker 10 starts operation. The marker 10 with the ejector 40 may be used on the exterior of aircraft to provide quick, rugged and inexpensive marking capabilities for law enforcement, military and other applications.

Other embodiments are possible. For example, the power switch could be a more common switch that can be manually placed on or off. In this case, the dashboard mount or the ejector dispenser would not be necessary to hold the marker and its power switch in the off position.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An audio visual homing marker, comprising:
- a shock-resistant housing,
- a power supply inside the housing;
- a power switch attached to the housing and the power supply, where the power switch is biased to the on position;
- an audio speaker inside the housing and attached to the power switch;
- an LED illumination array attached to the housing and the power switch; and
- a beacon ejector releasably retaining the beacon, the ejector including
  - a cylindrical body with a closed end and an open end;
  - a spring attached inside the closed end and providing a biasing force toward the open end;
  - a power switch block attached inside the closed end of the cylinder, the block maintaining contact with the power switch and biasing the power switch to the off position; and
  - a catch mechanism attached to the body adjacent to the open end of the cylinder, the catch acting to hold the beacon against the block and the spring.

2. The audio visual homing marker of claim 1, where the housing comprises a plurality of bulkheads that create a plurality of chambers, where the power supply, the audio speaker and the LED array are each contained within separate chambers.

3. The audio visual homing marker of claim 1, where the housing is a generally cylindrical polycarbonate structure.

4. The audio visual homing marker of claim 1, where the housing comprises a transparent material.

5. The audio visual homing marker of claim 1, where the LED array comprises a plurality of LEDs aft ached around the perimeter of the housing.

6. The audio visual homing marker of claim 1, where the audio speaker is a siren.

7. The audio visual homing marker of claim 1, where the LED array emits a non-visible light.

8. The audio visual homing marker of claim 1, further comprising
- a beacon dispenser releasably attached to the beacon, the dispenser including
  - a base;
  - a flexible semicircular band, the band partially surrounding the beacon and biased to hold the beacon against the base;
  - an upper tab attached at an upper end of the base;
  - a lower tab attached to a lower end of the base; and
  - a power switch block attached to the lower tab and facing the upper tab, the block maintaining contact with the power switch and biasing the power switch to the off position.

9. The audio visual homing marker of claim 1, the ejector further comprising:
- a solenoid mechanism attached to the catch mechanism; and
- a power source connected to the solenoid, where the solenoid is controllable remotely.

10. An audio visual homing marker, comprising:

a shock-resistant housing, a power supply inside the housing;

a power switch attached to the housing and the power supply;

an LED illumination array attached to the housing and the power switch; and a beacon ejector releasably retaining the beacon, the ejector including a cylindrical body with a closed end and an open end;

a spring attached inside the closed end and providing an biasing force toward the open end;

a power switch block attached inside the closed end of the cylinder, the block maintaining contact with the power switch and biasing the power switch to the off position; and a catch mechanism attached to the body adjacent to the open end of the cylinder, the catch acting to hold the beacon against the block and the spring.

11. The audio visual homing marker of claim 10, where the LED array emits a light that is not visible to the naked eye.

12. The audio visual homing marker of claim 10, further comprising:

a beacon dispenser releasably attached to the beacon, the dispenser including a base;

a flexible semicircular band, the band partially surrounding the beacon and biased to hold the beacon against the base;

an upper tab attached at an upper end of the base;

a lower tab attached to a lower end of the base; and a power switch block attached to the lower tab and facing the upper tab, the block maintaining contact with the power switch and biasing the power switch to the off position.

13. The audio visual homing marker of claim 10, the ejector further comprising:

a solenoid mechanism attached to the catch mechanism; and a power source connected to the solenoid, where the solenoid is controllable remotely.

* * * * *